US009728875B2

(12) United States Patent
Summa

(10) Patent No.: US 9,728,875 B2
(45) Date of Patent: Aug. 8, 2017

(54) MULTIPLE CONNECTOR

(71) Applicant: Hella KGaA Hueck & Co., Lippstadt (DE)

(72) Inventor: Karl-Heinz Summa, Groβlangheim (DE)

(73) Assignee: Hella KGaA Hueck & Co., Lippstadt (DE)

( * ) Notice: Subject to any disclaimer, the term of this patent is extended or adjusted under 35 U.S.C. 154(b) by 0 days.

(21) Appl. No.: 14/335,488

(22) Filed: Jul. 18, 2014

(65) Prior Publication Data

US 2015/0038017 A1 Feb. 5, 2015

(30) Foreign Application Priority Data

Jul. 30, 2013 (DE) ..... 10 2013 108 113

(51) Int. Cl.
*H01R 12/72* (2011.01)
*H01R 13/518* (2006.01)

(52) U.S. Cl.
CPC ..... *H01R 12/724* (2013.01); *H01R 13/518* (2013.01)

(58) Field of Classification Search
CPC ..... H01R 12/72; H01R 13/46; H01R 13/516; H01R 12/716; H01R 12/724; H01R 13/5219; H01R 13/514; H01R 13/518; H05K 5/03; H05K 5/0065; H05K 5/0069; H05K 5/0047
USPC ..... 439/559, 79, 629
See application file for complete search history.

(56) References Cited

U.S. PATENT DOCUMENTS

| | | | | |
|---|---|---|---|---|
| 6,059,608 | A * | 5/2000 | Benes | 439/620.07 |
| 6,699,076 | B2 * | 3/2004 | Wing | 439/620.08 |
| 6,808,397 | B2 * | 10/2004 | Kondo | H01R 12/7047 439/76.2 |
| 7,094,075 | B1 * | 8/2006 | Lim et al. | 439/79 |
| 7,099,155 | B2 * | 8/2006 | Kobayashi | B60R 16/0238 165/80.3 |
| 7,234,950 | B1 | 6/2007 | Wickett | |
| 8,523,581 | B2 * | 9/2013 | Martin et al. | 439/83 |
| 9,065,222 | B2 * | 6/2015 | Drew et al. | |

FOREIGN PATENT DOCUMENTS

| | | | |
|---|---|---|---|
| DE | 20318863 | U1 | 5/2005 |
| WO | 2013135793 | A2 | 9/2013 |

* cited by examiner

*Primary Examiner* — Amy Cohen Johnson
*Assistant Examiner* — Oscar C Jimenez
(74) *Attorney, Agent, or Firm* — Husch Blackwell LLP

(57) ABSTRACT

A multiple connector, in particular, for connecting to a printed circuit board. The multiple connector includes a base plate with essentially surrounding walls that project from the base plate and form a connector skirt. Electrical connecting tabs project through the base plate and pass through the base plate in the interior of a connector skirt, wherein Between at least two adjacent connector skirts, the base plate is interrupted by a contour projecting out from the plane of the base plate.

7 Claims, 2 Drawing Sheets

MULTIPLE CONNECTOR

CROSS REFERENCE

This application claims priority to German Patent Application No. 10 2013 108113.4, filed Jul. 30, 2013, which is hereby incorporated by reference.

FIELD OF THE TECHNOLOGY

The invention relates to a multiple connector, in particular, for connecting to a printed circuit board.

BACKGROUND

Many kinds of multiple connectors are known in the prior art. Such a multiple connector usually has a plurality of connector skirts that project from a base plate by means of at least partially surrounding walls and in which there are connecting tabs, in order to create an electrical plug-in connection with another connector part, wherein each connector part is inserted into a corresponding connector skirt. These multiple connectors are created by means of an injection molding process, wherein the connecting tabs are preferably injection molded along with the multiple connectors or set after the injection molding.

In the production of multiple connectors, it has been shown that the flow behavior of the plastic material during the injection molding process can be problematic depending on the length and the asymmetric shape of the multiple connector and the volume distribution, so that deficiencies in the uniformity of the multiple connectors can occur, which can lead, in turn, to problems during installation.

SUMMARY OF THE INVENTION

The problem of the invention is to disclose a multiple connector that at least improves or even eliminates the problems of the prior art.

One embodiment of the invention relates to a multiple connector, in particular, for connecting to a printed circuit board, with a base plate with essentially surrounding walls that project from the base plate and form a connector skirt, wherein there are electrical connecting tabs that project through the base plate and pass through the base plate in the interior of a connector skirt, wherein the base plate is interrupted by a contour projecting out from the plane of the base plate between at least two adjacent connector skirts. The interruption of the base plate ensures during the injection molding process that the plastic material flows in a targeted manner, because flow resistance is produced for the plastic material. This promotes the distribution of the material and reduces the problems presented in the prior art.

It is especially advantageous when the projecting contour is a contour with a u-shaped section. This produces a targeted flow resistance.

Alternatively it is advantageous if the projecting contour is a contour with an L-shaped section. This likewise produces flow resistance, wherein the base plate is thus arranged in different planes.

It is also advantageous if the base plate has a multiple part construction and is interrupted by each projecting contour.

Here it is advantageous if the base plate has a multiple part construction and the sub-areas of the base plate lie essentially in a plane. This can provide a good mechanical connection to a printed circuit board.

It is also advantageous if the contour with a u-shaped section has two adjacent wall sections that are connected by a third wall section, wherein one wall section is flush with a wall of a connector skirt. In this way it is achieved that two adjacent connector skirts are connected to each other through the connecting wall of the u-shaped contour.

It is also preferable if the contour with a u-shaped section has two adjacent wall sections that are connected by a third wall section, wherein each of the two adjacent wall sections are aligned with a wall of a connector skirt, wherein the two walls belong to adjacent connector skirts.

Other advantageous constructions are described by the following description of the figures and by the dependent claims.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
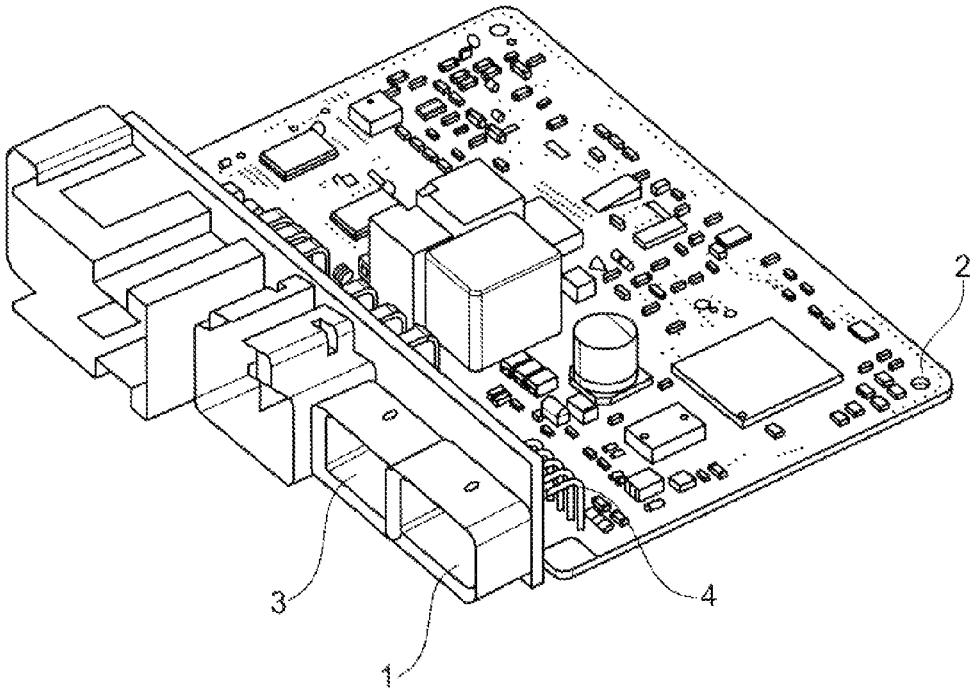
FIG. 1 is a schematic view of a multiple connector with a printed circuit board.

FIG. 1 shows an arrangement of a multiple connector 1 with a printed circuit board 2. The multiple connector 1 extends along a side edge of the printed circuit board 2 and has a row of connector skirts 3 that are arranged adjacent to each other in a row and are provided with connecting tabs 4, in order to be electrically connected to the printed circuit board.

It can be seen in FIG. 1 that the connector skirts 3 that form the multiple connector have different sizes in their dimensions, which is problematic for the manufacturing process.

Figure 2:
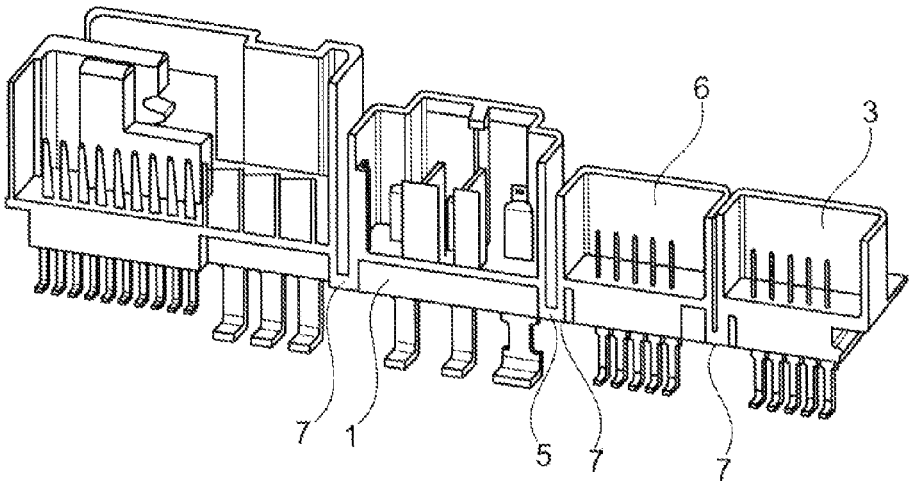
FIG. 2 is a schematic view of a multiple connector.

FIG. 2 shows an arrangement of a multiple connector 1 in section. The multiple connector 1 has a row of connector skirts 3 that are arranged adjacent to each other in a row and are provided with connecting tabs 4, in order to be able to electrically connect to the printed circuit board. The connecting tabs 4 project through a base plate 5 and extend into a spatial area that is surrounded by an essentially surrounding wall 6. Here, a connector skirt 3 is formed with the base plate 5 and the essentially surrounding wall 6. Between at least two adjacent connector skirts 3, the base plate 5 is interrupted by a contour 7 projecting out from the plane of the base plate.

The projecting contour 7 is formed in FIG. 2 as a u-shaped contour 7, wherein the contour can also have an L-shaped or v-shaped or similar construction.

Here, the base plate 5 that has a multiple part construction is interrupted between every two connector skirts 3 by a projecting contour 7.

Figure 3:
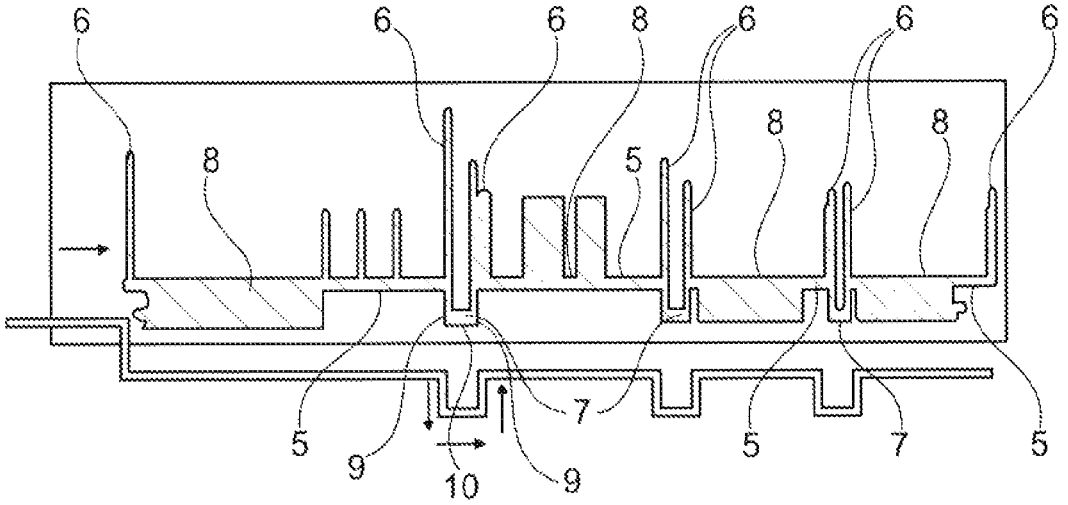
FIG. 3 is a multiple connector in a section view.

It can also be seen in FIG. 2 and FIG. 3 that the base plate 5 has a multiple part construction and each sub-area 8 of the base plate 5 is essentially in one plane.

According to the invention, the contour 7 with a u-shaped section has two adjacent wall sections 9 that are connected by a third wall section 10, wherein one wall section 9 is aligned with a wall 6 of a connector skirt 3.

Here it is advantageous according to the invention when each of the two adjacent wall sections 9 is aligned with a wall 6 of a connector skirt 3, wherein the two walls 6 belong to adjacent connector skirts 3.

LIST OF REFERENCE SYMBOLS

1 Multiple connector
2 Printed circuit board
3 Connector skirt
4 Connecting tab
5 Base plate
6 Wall
7 Contour
8 Sub-area
9 Wall section
10 Wall section

The invention claimed is:

1. A multiple connector for connecting to a printed circuit board, the multiple connector comprising:

a base plate including:

an upper surface in a first plane and a lower surface in a second plane parallel to the first plane;

a connector skirt enclosed on at least three sides by surrounding walls that project from the upper surface of the base plate such that said walls are perpendicular to the first plane; and a plurality of contours formed in the base plate, wherein a contour is a non-linear section of the lower surface and a matching non-linear section of the upper surface such that the contour forms a downward projection from the lower surface below the second plane and a corresponding recess in the upper surface below the first plane; and electrical connecting tabs projecting through the base plate and passing through the base plate in the interior of the connector skirt, wherein a contour in the base plate is positioned between at least two adjacent connector skirts.

2. The multiple connector according to claim 1, wherein the plurality of contours are u-shaped.

3. The multiple connector according to claim 2 wherein each of the plurality of u-shaped contours has two adjacent wall sections that are connected by a third wall section, wherein at least one of the adjacent wall sections is aligned with a surrounding wall of the connector skirt.

4. The multiple connector according to claim 2 wherein each of the plurality of u-shaped contours has two adjacent wall sections that are connected by a third wall section, wherein each of the two adjacent wall sections is flush with a surrounding wall of the connector skirt, wherein the two surrounding walls belong to the adjacent connector skirts.

5. The multiple connector according to claim 1, wherein the plurality of contours are L-shaped.

6. The multiple connector according to claim 1 wherein the base plate has a multiple part construction and is interrupted by one of the plurality of contours.

7. The multiple connector according to claim 1 wherein the base plate has a multiple part construction and the sub-areas of the base plate are essentially in one plane.

* * * * *